US006230598B1

(12) United States Patent
Ressler

(10) Patent No.: US 6,230,598 B1
(45) **Date of Patent: *May 15, 2001**

(54) AUTOMATIC CUTTING DEVICE

(76) Inventor: David J. Ressler, 3200 Old Winter Garden Rd. Apt. #2511, Ocoee, FL (US) 34761

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/016,508

(22) Filed: Jan. 30, 1998

(51) Int. Cl.[7] ..... B26D 5/38

(52) U.S. Cl. ..... 83/372; 83/373; 83/575; 83/694; 30/179; 30/180; 30/228

(58) Field of Search ..... 30/228, 179, 180; 83/575, 372, 694, 397, 360, 370, 373

(56) References Cited

U.S. PATENT DOCUMENTS 1,786,625 12/1930 Lindstrom et al. .
2,490,086 12/1949 Page .
2,718,059 9/1955 Koschak, Jr. .
3,834,020 9/1974 Caire .
4,198,748 4/1980 Lewis .
5,002,135 3/1991 Pellenc .

*Primary Examiner*—M. Rachuba
(74) *Attorney, Agent, or Firm*—Saliwanchik, Lloyd & Saliwanchik

(57) ABSTRACT

The present invention pertains to an automatic cutting device which can be utilized for cutting woody plant material (e.g., stem, stalk). The subject device can comprise a housing having a fixed blade attached thereto. A movable blade, pivotally connected to the fixed blade, can be attached to an activating device for movement. The activating device is preferably a pushrod activated by an electrical solenoid which produces the force necessary to push the movable blade against the fixed blade in a cutting action. A spring can be used to return the movable blade to the open position between cuts. The solenoid can be activated by a switching means which is triggered by a lever device located in close proximity to the cutting portion of the blades. In a specific embodiment, as the stem is lowered, the lever is depressed which triggers the switch to activate the solenoid. The solenoid forces the push rod to push the movable blade against the fixed blade in a single cutting action to cut the stem. The movable blade then returns to the open position via a spring means.

21 Claims, 2 Drawing Sheets

AUTOMATIC CUTTING DEVICE

FIELD OF THE INVENTION

The present invention relates generally to an automatic cutting device. More specifically, the present invention relates to an automatic cutting device designed for cutting woody plant material which is automatically triggered by insertion of the plant material into the cutting area.

BACKGROUND OF THE INVENTION

Various types of garden tools are known for cutting woody plant material such as branches, stems, stalks or the like. Most of these tools require an operator to grasp a pair of handles to move two blades together to cut the woody plant material between the blades. These hand operated mechanical tools (e.g., shears) may be handy for the occasional cutting by home gardeners, but for hardy materials or repetitive use, such shears prove to be inadequate, tiresome and time consuming. To address these problems, power-assisted-hand-operated cutting tools have been developed. For example, U.S. Pat. No. 2,718,059 entitled "Gardening Implement" describes a hand-held garden trimmer with an electrically activated moving blade and a push-button actuated switch for cutting and trimming lawns, hedges, and shrubbery. U.S. Pat. No. 4,198,748 entitled "Hydraulically Actuated Garden Tool" also describes a hand-held garden tool which is activated when the handle is actuated to move the blade into the guide to cut a branch. Other power-assisted hand-held gardening tools are described in U.S. Pat. Nos. 1,786,625; 2,490,086; 3,834,020; and 5,002,135.

A main disadvantage for all of these types of tools is that each is required to be held by an operator and each requires an operator-assisted trigger mechanism for use. Requiring an operator to hold the cutting tool not only monopolizes use of one of the operator's hands but also leads to fatigue in carrying such a tool. Requiring operator-assisted trigger activation also prevents the operator from having his hands free, slowing down the process and further intensifying fatigue.

Accordingly, there is a need in the art for a cutting device which leaves the operator's hands free to handle the plant materials. There is a further need in the art for a cutting device which is not required to be hand-held or require operator-assistance trigger activation. There is a further need in the art for a fast, economical and easy-to-operate device which readily and safely cuts woody plant material, suitable for commercial, high-repetitive use.

The subject invention solves the above-described needs in the art by providing an automatic cutting device which can be utilized for cutting woody plant material, wherein the device can be automatically triggered by insertion of the plant material into the cutting area.

BRIEF SUMMARY OF THE INVENTION

The subject invention pertains to an automatic cutting device which can be utilized for cutting woody plant material (e.g., stem, stalk). In a preferred embodiment, the device comprises a housing having a fixed blade attached thereto. A movable blade, pivotally connected to the fixed blade, can be attached to an activating device for movement. The activating device is preferably a pushrod activated by an electrical solenoid which produces the force necessary to push the movable blade against the fixed blade in a cutting action. A spring can be used to return the movable blade to the open position between cuts. The solenoid can be activated by a switching means which can be, for example, triggered by a lever device located in close proximity to the cutting portion of the blades. In this embodiment, as the plant stem is lowered, the lever is depressed which triggers the switch to activate the solenoid. The solenoid forces the push rod to push the movable blade against the fixed blade in a single cutting action to cut the stem. The movable blade then returns to the open position via, for example, a spring means. The cutting blades may be provided with a safety guard. A main safety switch such as a foot pedal may also be provided. In addition to the cutting blades, a sharpened member may be provided near the cutting blades to allow the operator to nick, or wound, the cut end of the plant stem as the stem is being removed to provide an angular groove in the cut end of the stem allowing for a larger surface area for water absorption. The device itself is preferably mounted on a table top for ease of operation and to allow the operator to keep both hands free.

Accordingly, it is an object of the present invention to provide a fast, economical, easy to operate device which readily and safely cuts woody plant material and is suitable for commercial, high-repetitive use. It is a further object of the present invention to provide a stand-alone device which does not require operator handling or triggering to utilize the device.

DETAILED DISCLOSURE OF THE INVENTION

Figure 1:
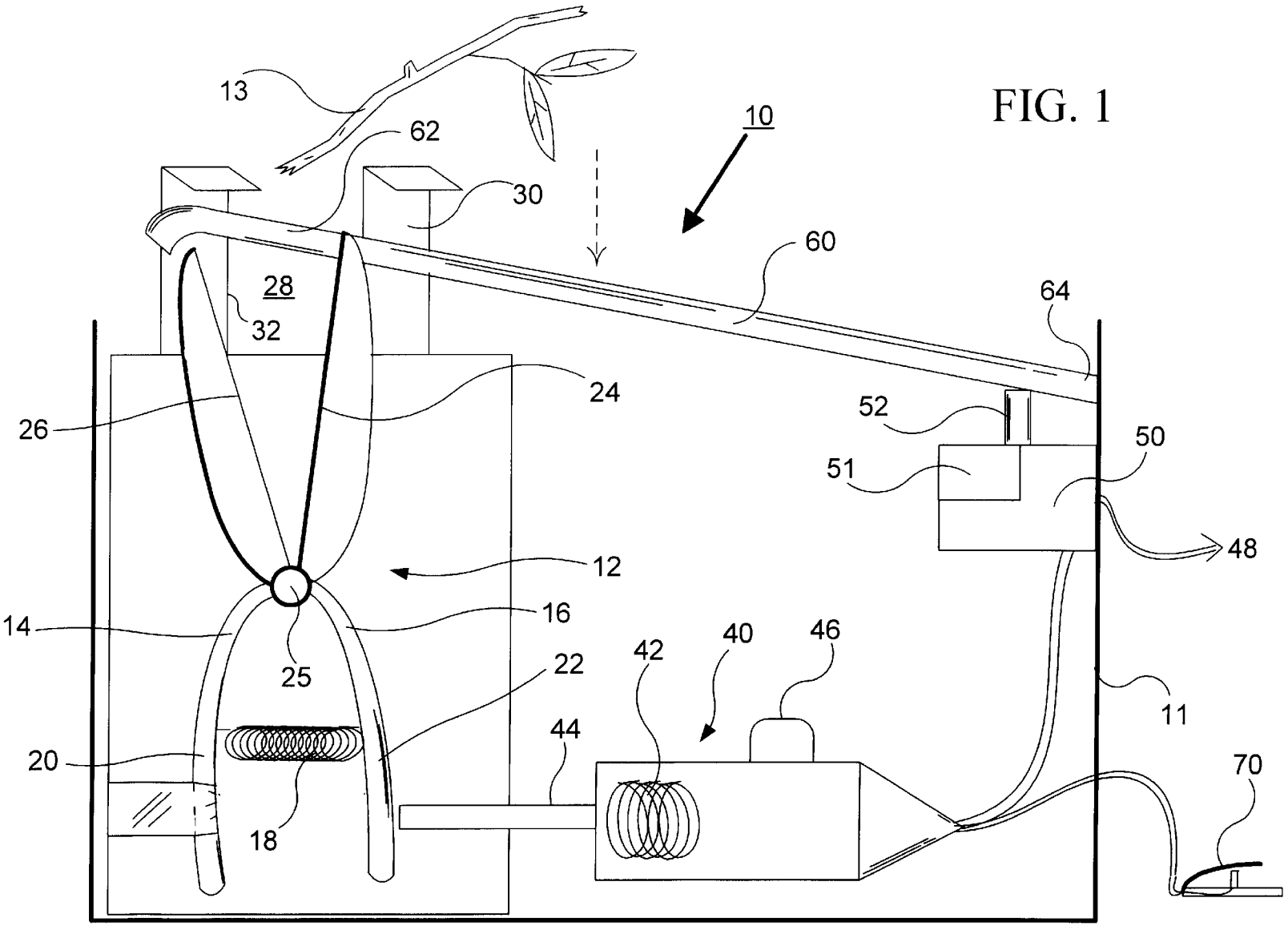
FIG. 1 is a perspective view of the cutting device of the present invention with a portion of the housing removed to view the contents.

Referring now to the drawings, a specific embodiment of an automatic cutting device 10 in accordance with the subject invention is shown in FIG. 1. The automatic cutting device 10 can comprise a housing 11 having a cutting means 12 affixed thereto, such as a pair of shears or any of various implements or machines, for example, that cut with a scissorlike or chopping action. In a preferred embodiment, the cutting means 12 comprises a movable blade member 16 pivotally connected to a fixed blade member 14. The fixed blade member 14 is secured to the housing to remain stationary. The fixed blade member 14 may be a sharpened surface or merely a hard contact surface for the movable blade. Each of the respective blade members 14, 16 can comprise a handle portion 20, 22 at one end and a cutting edge 24, 26 at the other, respectively. The cutting edges 24, 26 are preferably sufficiently sharpened for cutting. A pin 25 or other fastening means can pivotally attach the moveable blade member 16 to the fixed blade member 14.

A spring 18 or like elastic device, which can regain its original shape after being compressed or extended, can be used to separate the handle portions 20, 22 after each cut, keeping the cutting edges 24, 26 apart to provide a cutting area 28 therebetween. A raised guard 30 attachment, covering, or like device that can prevent injury or damage, especially to protect the operator, may be provided to shield the cutting area 28 and cutting edges 24, 26 for safety reasons. The guard 30 can be designed such that the woody plant material 13 may be readily inserted therebetween into the cutting area 28 for cutting, and such that guard 30 can also act as a guide for the plant material.

The handle portion 22 of the movable blade member 16 can be attached to an activating device 40 for movement.

The activating device 40 may be any type of motor machine or engine that produces or imparts motion, including electric solenoid, hydraulic piston, compressed air or other activating device well known by those in the art. The activating device 40 preferably consists of a pushrod 44 connected to, or part of, a solenoid core or a plunger activated by the coil of a solenoid 42 which produces the force necessary to push the movable blade handle 22 such that the movable blade member 16 pivots on pin 25, causing the movable blade cutting edge 26 to close against the fixed blade cutting edge 24 in a cutting action. The solenoid can be of standard construction, for example, consisting of a coil and a metal core free to slide along the coil axis under the influence of the magnetic field. The solenoid 42 can be powered by any suitable power source 48, such as AC current of any frequency or DC current rendered pulsating by any suitable make and break arrangement.

Suitable circuitry 46 to drive the solenoid can be provided, wherein such circuits are well known in the art. In a specific embodiment, as the solenoid 42 is energized, the pushrod 44 attached to the solenoid core will be pushed outward against the movable blade handle 22 forcing the handles 20, 22 together thereby bringing the cutting edges 24, 26 into a closed relation in a swift cutting scissorlike action. On de-energization of the solenoid 42, the pushrod 44 can be returned to its initial position, via, for example, spring 18, which can force the handles 20, 22 apart, in effect opening the cutting edges 24, 26. In an alternate embodiment, the pushrod 44 may pull apart the handles 20, 22 so that a spring is not necessary.

In alternative embodiments of the subject invention, the subject device can be designed wherein handles 20 and 22 both move to provide a cutting action. Such movement can be provided by appropriate activating devices in accordance with the subject invention.

In a specific embodiment, solenoid 42 can be activated by a switching means 50 which energizes the solenoid 42. The switching means 50 can include suitable circuitry 51 to allow energization of the activating device 40, for example solenoid 42. The switching means 50 can be automatically activated by a lever 60, or similar device used to activate the switch, for example pivotally mounted on the housing 11. One end of the lever 60, the pivot end 64, can contact the switch means 50, for example at button 52, when the other end of the lever 60, the contact end 62, is depressed. The contact end 62 of the lever 60 is preferably positioned parallel to the sharpened ends 24, 26 of the cutting device 10 in close proximity to the cutting area 28. The contact end 62 of the lever 60 is preferably disposed within the guard 30. Accordingly, when a plant stem is brought into cutting area 28 to be cut, the stem can depress the contact end 62 of lever 60 such that the pivot end 64 of lever 60 presses button 52 of switch 50, energizing activating device 40 and cutting the plant stem. In an alternate embodiment an electronic sensor or a break in a beam of light or other suitable activation device may be used to activate the switch 50.

Figure 2:
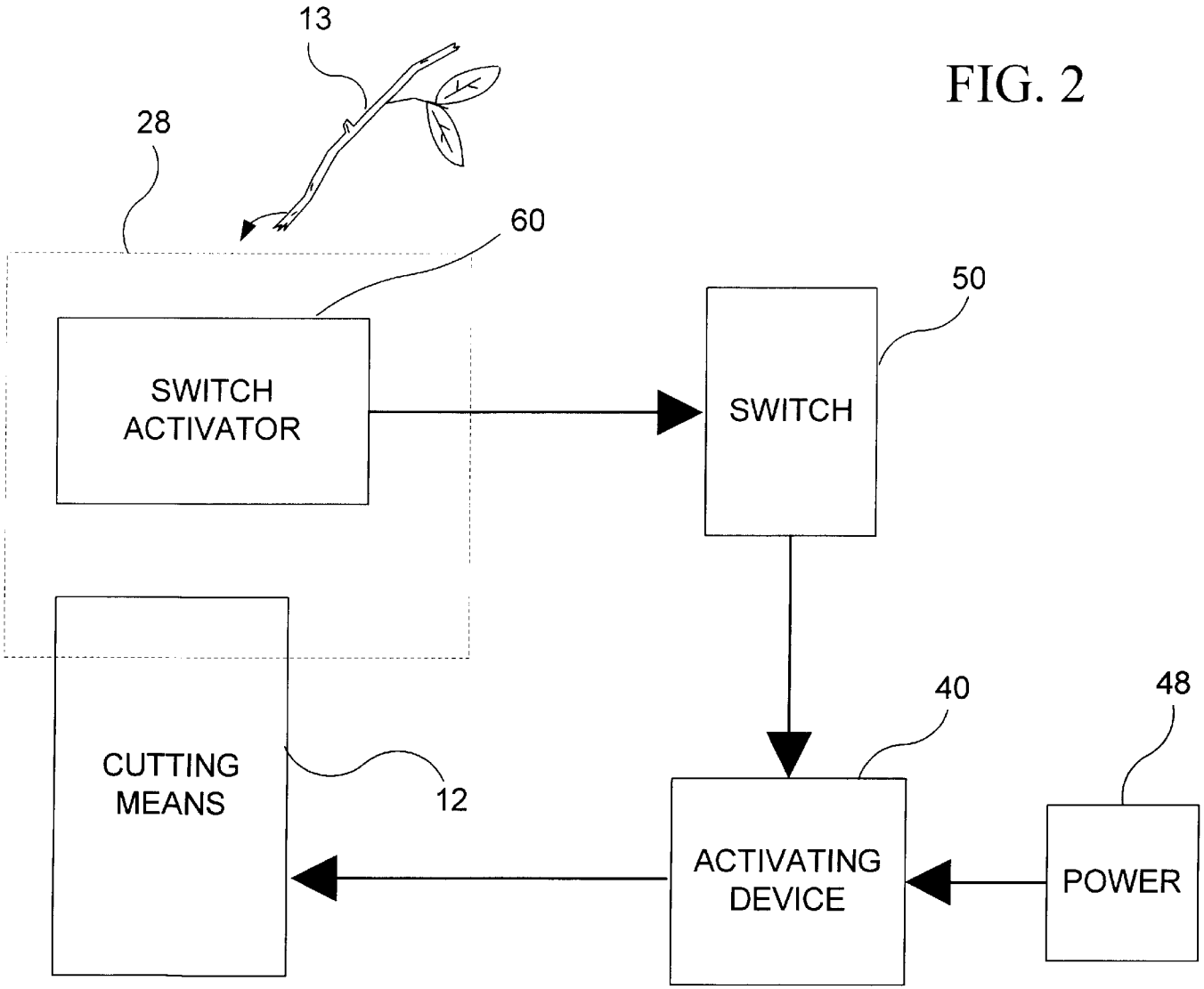
FIG. 2 is a block diagram generally illustrating the relation between elements.

In a preferred embodiment, in operation, the cutting device 10 can be securely mounted or positioned on a work area such as a table top or other suitable horizontal surface. A main power source 48 can be provided. A foot pedal 70 or other suitable main safety switch, such as a foot-operated lever or sensor pad, may be provided which regulates and controls the main power source 48. Referring to FIG. 2, the woody plant material to be cut can be inserted perpendicular to the cutting edges 24, 26 past the guard 30 into the cutting area 28. As the woody plant material is inserted into the cutting area 28, the plant material can contact the contact end 62 of the lever 60, pushing the lever 60 downward. The movement of the lever 60 downward causes the pivot end 64 to contact the switch button 52 of switch 50, activating the switching circuitry 51. The switching circuitry 51 allows energization of the solenoid 42. Once energized, the solenoid 42 can cause the pushrod 44 to move against the handle 22 of the movable blade member 16 thereby forcing the handles 20, 22 together and bringing the cutting edges 24, 26 into a closed relation in a cutting action with sufficient force to cut the woody plant material. The lever 60 returns to its initial position once the plant material is cut or removed, for example, by the force of switch button 52 or some other restoring force. The solenoid 42 is deactivated and the cutting edges 24, 26 separate, for example, due to spring 18.

In a preferred embodiment, the switch 50 can be designed to send a single pulse to the solenoid 42 such that only a single cut is made by the cutting device 10. In an alternate embodiment, the switching means 50 may be designed to continue sending pulses to the solenoid 42 such that the cutting edges 24, 26 open and close multiple times, if, for example, the plant material requires more than one closing of the cutting edges 24, 26 to cut the plant material. The guard 30 may further include a sharpened edge 32 along the inside thereof to "wound" or "nick" the plant material. Accordingly, in operation, after the plant material is cut, the cut end of the stem may be pushed against the sharpened edge 32 as it is being removed to create a wound in the cut end of the stem allowing for a larger surface area for water absorption.

It should be understood that the embodiments described herein are for illustrative purposes only and that various modifications or changes in light thereof will be suggested to persons skilled in the art and are to be included within the spirit and purview of this application and the scope of the appended claims.

What is claimed is:

1. An automatic cutting device for cutting an elongated object comprising:

a) a movable blade;

b) driving means attached to said movable blade for providing movement to said movable blade; and c) automatic triggering means for activating said driving means when an elongated object is brought into a cutting area of said movable blade, wherein upon activation of said automatic triggering means the elongated object is in position to be cut and is cut by the moveable blade without further movement of the elongated object.

2. The device of claim 1 further comprising a fixed blade to which said movable blade is pivotally connected thereto such that said movable blade operates in cooperation with said fixed blade in a scissor like action with said cutting area located between said movable blade and said fixed blade.

3. The device of claim 2 further comprising a free-standing housing upon which said fixed blade is mounted.

4. The device of claim 2 wherein said electronic solenoid comprises a coil and a metal core disposed therein, said metal core free to slide along said coil axis under the influence of a magnetic field, said core attached to a pushrod, said pushrod attached to said movable blade.

5. The device of claim 4 wherein said solenoid is activated by said automatic triggering means.

6. The device of claim 2 wherein said automatic triggering means comprises a lever positioned in close proximity to said cutting area.

7. The device of claim 6 wherein said automatic triggering means is activated when the object is brought into said cutting area and causes said lever to move.

8. The device of claim 7 wherein said driving means comprises an electronic solenoid.

9. The device of claim 8 wherein said electronic solenoid comprises a coil and a metal core disposed therein, said metal core free to slide along said coil axis under the influence of a magnetic field, said core attached to a pushrod, said pushrod attached to said movable blade.

10. The device of claim 1 further comprising a guard positioned around said cutting area for safety.

11. The device of claim 10 further comprising a sharpened edge on said guard for slicing a groove into the cut end of the object.

12. The device of claim 1 further comprising a main safety switch wherein said main safety switch comprises a foot-activated pedal which controls a main power source which powers said driving means, wherein said driving means can only be activated by said automatic triggering means when said main safety switch is engaged.

13. The device of claim 2 further comprising elastic means to separate said movable blade and said fixed blade.

14. The device of claim 13 wherein said elastic means comprises a spring.

15. A device for cutting plant material comprising:

a) cutting means;

b) triggering means for activating said cutting means when plant material is brought into a cutting area of said cutting means, wherein upon activation of said cutting means the plant material is in position to be cut and is cut by the cutting means without further movement of the plant material.

16. The device, according to claim 15, wherein said cutting means is secured to a free-standing housing.

17. The device, according to claim 15, further comprising a foot-operated safety switch, wherein said cutting means can only be activated by said triggering means when said foot-operated safety switch is engaged.

18. The device, according to claim 15, further comprising a guide, wherein said guide helps to guide plant material into said cutting area for cutting.

19. The device, according to claim 18, further comprising wounding means for wounding an end of a plant stem which has been cut by said cutting means.

20. The device, according to claim 19, wherein said wounding means is a sharpened edge of said guide, whereby after guiding a plant stem into said cutting area and activating said cutting means to cut the plant stem, the end of the plant stem can be scraped against the sharpened edge of said guide so as to wound said end of the plant stem.

21. The device according to claim 2, wherein said driving means comprises an electronic solenoid.

* * * * *